US005333968A

United States Patent [19]

Bauer

[11] Patent Number: 5,333,968

[45] Date of Patent: Aug. 2, 1994

[54] LENGTH-ADJUSTABLE COLUMN FOR TABLES, CHAIRS OR THE LIKE

[75] Inventor: Hans J. Bauer, Altdorf, Fed. Rep. of Germany

[73] Assignee: Suspa Compart Aktiengesellschaft, Altdorf, Fed. Rep. of Germany

[21] Appl. No.: 4,244

[22] Filed: Jan. 14, 1993

[30] Foreign Application Priority Data

Jan. 14, 1992 [DE] Fed. Rep. of Germany ..... 4200786

[51] Int. Cl.[5] ..... A47B 9/00; A47C 3/00; F16F 9/00

[52] U.S. Cl. ..... 403/377; 403/109; 403/83

[58] Field of Search ..... 403/104, 109, 103, 84, 403/83, 377; 248/161

[56] References Cited

U.S. PATENT DOCUMENTS 3,711,054 1/1973 Bauer .
4,899,969 2/1990 Bauer et al. .
4,979,718 12/1990 Bauer et al. .
5,131,615 7/1992 Hosan et al. ..... 248/161
5,152,646 10/1992 Bauer .

FOREIGN PATENT DOCUMENTS 0133524 7/1984 European Pat. Off. .
0258656 8/1987 European Pat. Off. .
0325726 11/1988 European Pat. Off. .
4009034 9/1991 Fed. Rep. of Germany .
4034633 5/1992 Fed. Rep. of Germany .
4102002 7/1992 Fed. Rep. of Germany .

*Primary Examiner*—Randolph A. Reese
*Assistant Examiner*—Anthony Knight
*Attorney, Agent, or Firm*—Browdy and Neimark

[57] ABSTRACT

A length-adjustable column for chairs, tables or the like has a length-adjusting element and a stand pipe. The stand pipe is in the form of a composite pipe and has an outer tube and an inner guide tube, which are connected with each other by guide webs. On the internal surface of the inner guide tube, partial cylinder surfaces are produced by chip removal as guide surfaces for the cylindrical housing of the length-adjusting element.

11 Claims, 2 Drawing Sheets

LENGTH-ADJUSTABLE COLUMN FOR TABLES, CHAIRS OR THE LIKE

FIELD OF THE INVENTION

The invention relates to a length-adjustable column for chairs, tables or the like, with a stand pipe and a pneumatic or hydropneumatic length-adjusting element arranged therein concentrically of a common central longitudinal axis and of which the cylindrical housing is radially supported in the stand pipe is slidably guided in the direction of the central longitudinal axis and of which the piston rod, in the vicinity of its free end, is arrested on a bottom plate of the stand pipe in the direction of the central longitudinal axis.

BACKGROUND OF THE INVENTION

Columns of the generic kind as disclosed in U.S. Pat. No. 3,711,054 or in U.S. Pat. No. 4,979,718 have an outer stand pipe of metal, a guide sleeve of plastic material, which extends only over part of the length of the stand pipe, being arranged in the latter's upper portion facing away from the bottom plate.

U.S. Pat. No. 5,152,646 has already proposed to shape such guide sleeves on their internal surface by broaching such that, spread over the circumference, partial cylinder surfaces are provided as guide surfaces with recesses in between them, in which a lubricant can be stored.

SUMMARY OF THE INVENTION

It is an object of the invention to embody a column of the generic kind such that the stand pipe can be produced at a low cost simultaneously providing for precise, stable lateral guidance of the length-adjusting element.

The object is attained in accordance with the invention in that the stand pipe is in the form of a composite pipe integrally injection-moulded of plastic material and consists of an outer tube and an inner guide tube supported against the latter by guide webs, and in that partial cylinder surfaces, which are concentric of the axis and produced by chip removal on an internal surface of the inner guide tube and separated from each other by recesses, are formed as guide surfaces for the housing. The measures according to the invention ensure that, being formed as a composite pipe, the stand pipe is extremely rigid. The outer tube and the inner guide tube may be formed to have very thin walls, since the rigidity results from their being structured as a composite pipe. The stand pipe can be manufactured at a minimum expense of plastic material. The chip-removing processing, for instance by broaching, of the partial cylinder surfaces serving as guide surfaces ensures the housing of the length-adjusting element being guided very precisely. Only comparatively narrow chips are cut due to the fact that along the circumference, only partial cylinder surfaces are in each case subjected to the chip-removing processing leaving recesses between them, it being assured by this kind of shaping that the partial cylinder surfaces are not damaged during the chip-removing processing, in particular by broaching. High surface quality of the partial cylinder surfaces is secured.

Further features, details and advantages of the invention will become apparent from the ensuing description of two examples of embodiment taken in conjunction with the drawing.

DESCRIPTION OF THE PREFERRED EMBODIMENTS

Figure 1:
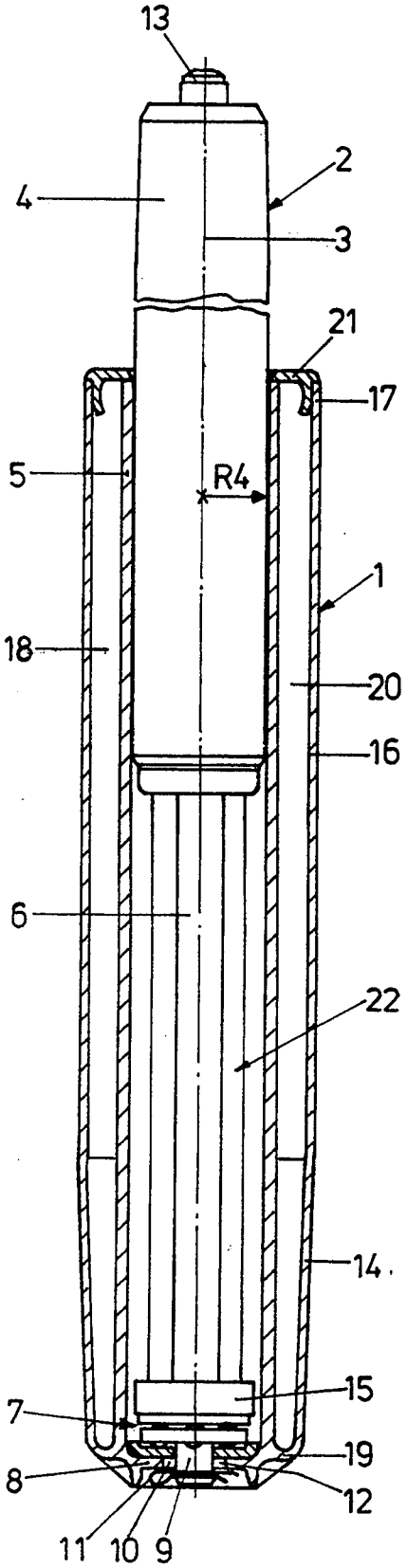
FIG. 1 is a longitudinal view of a column according to the invention with the stand pipe shown in section.

The chair column illustrated in the drawing has a stand pipe 1, in which a length-adjustable gas spring 2 is arranged as a pneumatic or hydropneumatic piston-cylinder adjusting element. The stand pipe 1 and the gas spring 2 have a common central longitudinal axis 3.

An outer housing 4 of the gas spring 2 is supported in an inner guide tube 5 of the stand pipe 1 for displacement in the direction of the axis 3. The guide tube 5 extends of the full length of the stand pipe 1. The outer housing 4 of the gas spring may be its proper housing or a protecting tube surrounding the latter.

A piston rod 6 projects over the housing 4 of the gas spring 2 and is supported by way of an axial rolling bearing 7 against a bottom plate 8 of the stand pipe 1 in the direction of the axis 3. A journal 9 of the piston rod 6 passing through the axial rolling bearing 7 extends through an opening 10 of the bottom plate 8 formed concentrically of the axis 3. It is safeguarded against being pulled out of the bottom plate 8 by means of a spring-loaded retaining ring 11 bearing against the latter's lower side. The diameter of the opening 10 is greater than the diameter of the journal 9. The gas spring 2 is rotatable in relation to the stand pipe 1 due to the described fastening. By reason of the radial play 12 between the journal 9 and the opening 10 it is guided in the inner guide tube 5 to be to some minor degree tiltable in relation to the stand pipe 8, i.e. free of jamming. Finally, referred to the stand pipe 1, it is arrested with its piston rod 6 in the direction of the axis 3, so that the housing 4 of the gas spring 2 is moved out of or into the stand pipe 1 by actuation of an actuating pin 13 for any adjustments in length of the gas spring 2. The actuating pin 13 is loacted at the end of the housing 4 of the gas spring 2 which is opposite to the piston rod 6. This also serves to fasten a chair seat or a table top.

The stand pipe 1 has, adjacent to the bottom plate 8, a conical section 14 which slightly tapers conically towards the latter and by means of which fastening of the stand pipe 1 in a corresponding conical bush of a chair cross or the like is possible. On the piston rod 6 and adjacent to the axial rolling bearing 7 a stop damper ring 15, for instance of foamed elastic plastic material, is arranged serving to prevent the housing 4 from hitting against the axial rolling bearing 7.

The stand pipe 1 has a continuous, smooth-surface outer tube 16 provided with a conical section 14. It is of smooth cylindrical outward shape between the conical section 14 and the upper end 17 facing away from the bottom plate 8. It also extends concentrically of the central longitudinal axis 3. The outer tube 16 is formed in one piece with the inner guide tube 5, the stand pipe forming a double-walled composite pipe. The inner guide tube 5 and the outer tube 16 are connected with each other by means of supporting webs 18 extending radially to the axis 3 and equally being formed in one piece with the two tubes 5, 16. The bottom plate 8 is also formed in one piece with the stand pipe 1. The guide tube 5 and the outer tube 16 are connected with each other adjacent to the bottom plate 8 by means of a bottom ring 19, so that the cavities 20 between two adjacent supporting webs 18 and the corresponding sections of the inner guide tube 5 and the outer tube 16 form channels that are closed downwards. At the upper end 17 of the stand pipe 1, these cavities 20 are closed by means of an elastically lockable covering ring 21.

The stand pipe 1 is made in one piece by injection-moulding of plastic material, preferably of a polyacetal. After extrusion the internal surface 22 of the inner guide tube 5 is undersize in relation to the circular cylindrical housing 4 of the gas spring 2, this undersize being necessary so that the inner guide tube 5 of the stand pipe 1 can be provided by a chip-removing process with a very accurately calibrated inner surface 22 serving as a guide surface for the housing 4.

Figure 2:
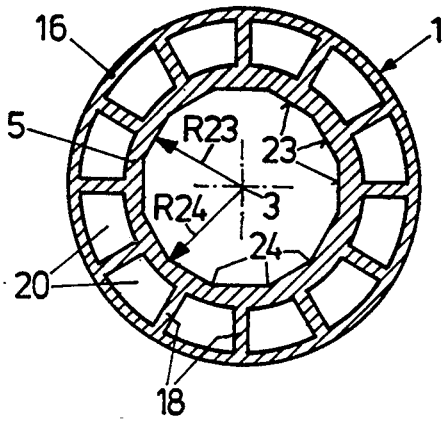
FIG. 2 is a cross-section through the stand pipe according to FIG. 1.

As seen in FIGS. 1 and 2, the internal surface 22 of the guide tube 5 is of polygonal shape prior to the mentioned processing, namely in the form of a regular polygon, of which the central axis is also formed by the axis 3. It is for instance in the form of a regular duodecagon. It is formed by surfaces 23, of which the edges—referred to the axis 3—form recesses 24. Consequently, the distance R24 of each recess 24 from the axis 3 is greater than the smallest distance R23 of the surfaces 23 from the axis 3, this smallest distance R23 being in each case located in the middle between two edges or recesses 24. In comparison to the radius R4 of the cylindrical housing, $R24 > R4 > R23$ applies.

The internal surface 22 structured as described above, of the inner guide tube is broached in the course of the chip-removing calibration in a single broaching operation, i.e. by means of a broach, which has cutting teeth extending over the full circumference and with a circular blade. As shown on an enlarged scale in the partial representation according to FIG. 3—partial cylinder surfaces 25 arranged symmetrically in relation to the axis 3 with a radius R25 are broached in the surfaces 23, the relation $R24 > R25 \geqq R4$ applying, and R25 being greater than R 4 by some hundredths of a millimeter at maximum, for example by up to 0.05 mm. During this broaching operation partial areas are cut off the surfaces 23, these partial areas formed by the partial cylinder surfaces 25 being separated from one another by the recess 24 located in between. The chips cut off each surface 23 therefore have a width that maximally corresponds to the width a of the corresponding partial cylinder surface 25. The chips cut off adjacent surfaces 23 are interrupted in the area of the recess 24 located in between them. This kind of broaching of the partial cylinder surfaces 25 causes that the latter are broached to be very smooth with high surface quality, because the plastic chips resulting from the broaching can be easily discharged. There is no risk of their getting stuck between the cutting teeth of the broaching tool and the internal surface 22 of the inner guide tube 5 and damaging the latter's surface. The sum of the partial cylinder surfaces 25 forms the actual guide surface of the inner guide tube 5 vis-à-vis the housing 4 of the gas spring 10.

The remaining groove-like recesses 24 can be used as lubricating grooves, i.e. as storage rooms for a lubricant 26. This is feasible in simple manner in particular when these recesses 24 are closed at the bottom by the bottom plate 8, so that the lubricant cannot exit downwards out of the stand pipe 1.

Figure 3:
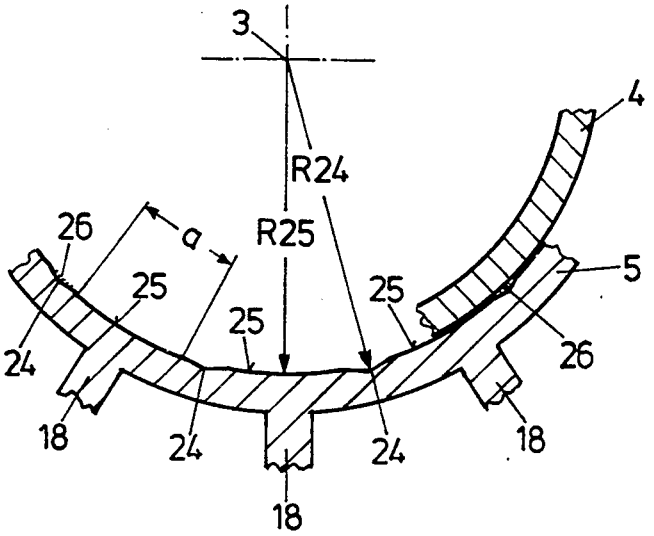
FIG. 3 is a partial cross-section through the stand pipe after chip-removing processing.
Figure 4:
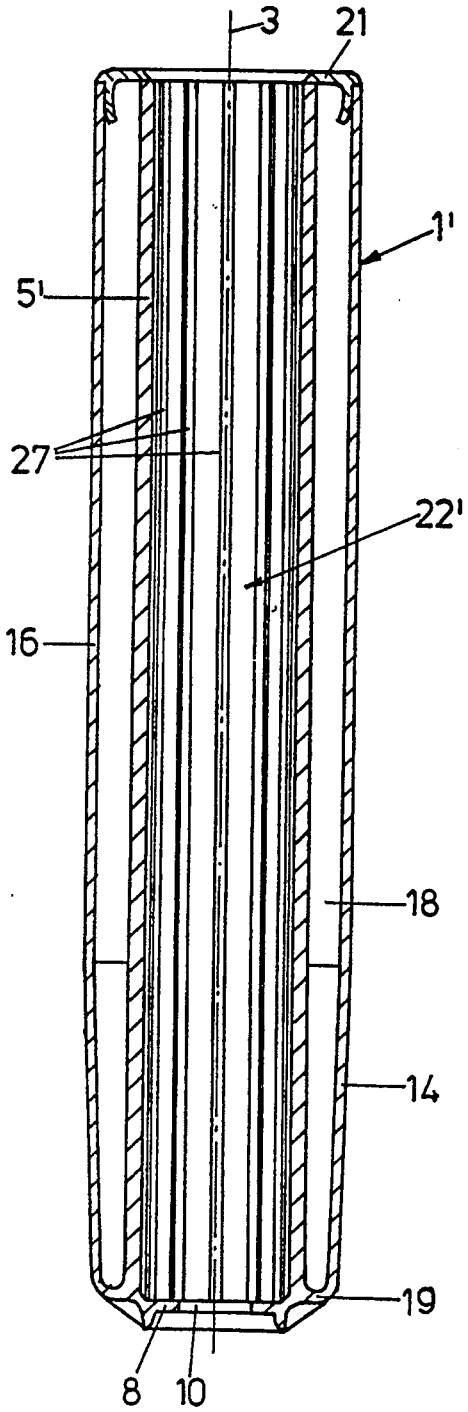
FIG. 4 is a longitudinal section of a further embodiment of a stand pipe.
Figure 5:
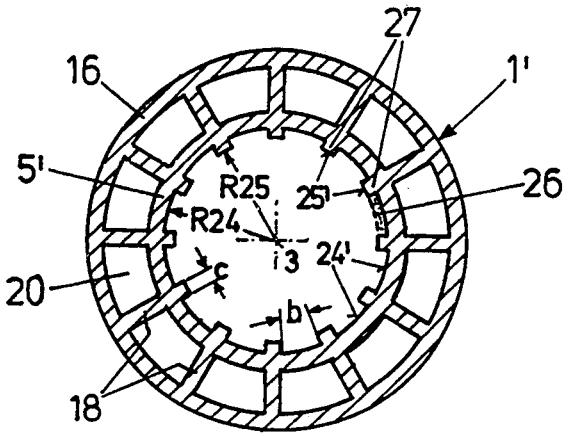
FIG. 5 is a cross-section through the stand pipe according to FIG. 4.

The embodiment according to FIGS. 4 and 5 differs from the embodiment according to FIGS. 1 to 3 only in the design of the internal surface of the inner guide tube 5. This is why in FIGS. 4 and 5, parts that are identical with FIGS. 1 to 3 have identical reference numerals; parts of identical function but not identical in construction have the same reference numerals provided with a prime. There is no need of a renewed detailed description.

In the example of embodiment according to FIGS. 4 and 5 guide webs 27 are formed on the internal surface 22' of the inner guide tube 5'. They extend over the full axial length of the inner guide tube 5' and project radially from the internal surface 22' towards the axis 3. They are equally formed in one piece with the stand pipe 1'. Prior to the calibration by broaching mentioned before and identical in this regard, the guide webs 27 are oversize towards the axis 3. This is reduced by the broaching operation so that then partial cylinder surfaces 25' are formed on the guide webs 27 and constitute the actual guide surfaces vis-à-vis the housing 4 of the gas spring 2. Between adjacent guide webs 27 corresponding recesses 24' extend as parts of the internal surface 22'. The relation $R24' > R25' \geqq R4$ applies to the radius R25' of the partial cylinder surfaces 25' from the axis 3 and the distance R24' of the recesses 24' from the axis 3 related to the radius R4 of the housing 4, in this case, too, R25' being greater than R4 only by some hundredths of a millimeter at maximum, for instance by up to 0.05 mm.

As seen in FIG. 5, twelve guide webs 27 are provided in the present example of embodiment to extend at equal angular distances and in parallel to the axis 3. The width b of the recesses 24' in the circumferential direction is about double the size of the width c of the partial cylinder surfaces 25'. In these recesses 24', too, a lubricant 26 may be stored.

Fundamentally, any other suitable chip-removing processing method may be used instead of the described broaching, such as push-type broaching which is very much like press-type broaching. If a broaching tool cannot be completely pulled or forced through the inner guide tube 5 or 5' because of the bottom plate 8, it can be useful to provide a cut-out in the internal surfaces 22 or 22' in a portion adjacent to the bottom plate 8, so that there any chip removing processing can be dispensed with, without, however, the complete introduction of the housing 4 into the stand pipe 1 or 1' being hampered.

What is claimed is:

1. A length-adjustable column for chairs or tables, comprising a stand pipe (1, 1') and one of a pneumatic and a hydropneumatic length-adjusting element arranged therein concentrically of a common central longitudinal axis (3) and of which a cylindrical housing (4) is radially supported in the stand pipe (1, 1') and is slidably guided in the direction of a central longitudinal axis (3) and of which a piston rod (6), adjacent to a free end, is arrested on a bottom plate (8) engaged to the stand pipe (1, 1') in the direction of a central longitudinal axis (3), wherein the stand pipe (1, 1') is in the form of a composite pipe integrally injection-moulded of plastic material and consists of an outer tube (16) and an inner guide tube (5, 5') supported against said outer tube

(16) by guide webs (18), and wherein partial cylindrical surfaces (25, 25'), which are concentric of the central longitudinal axis (3) and formed by chip removal on an internal surface (22, 22') of the inner guide tube (5, 5') and separated from each other by recesses (24, 24'), are formed as guide surfaces for the housing (4).

2. A column according to claim 1, wherein the inner guide tube (5, 5') with the partial cylindrical surfaces (25, 25') extends substantially over the full length of the stand pipe (1, 1').

3. A column according to claim 1, wherein the relation $R24 > R25 \geqq R4$ or $R24' > R25' \geqq R4$ applies to the radius (R25, R25') of the partial cylindrical surfaces (25, 25') and the distance (R24, R24') of the recesses (24, 24') in relation to the radius (R4) of the housing (4)

wherein said distance (R24, R24'), said radius (25, 25'), and said radius (4) are each measured from the central longitudinal axis (3).

4. A column according to claim 1, wherein the partial cylindrical surfaces (25, 25') are arranged at equal angular distances one in relation to the other.

5. A column according to claim 1, wherein the partial cylindrical surfaces (25) are formed on surfaces (23) of the internal surface (22) of the inner guide tube (5) having a cross-section of a regular polygon symmetrical to the central longitudinal axis (3).

6. A column according to claim 1, wherein the partial cylindrical surfaces (25') are formed on guide webs (27) projecting from the internal surface (22') of the inner guide tube (5') towards the central longitudinal axis (3).

7. A column according to claim 6, wherein in a circumferential direction of the inner guide tube (5'), the width (b) of the recesses (24') is greater than the width (c) of the partial cylindrical surfaces (25') in said circumferential direction.

8. A column according to claim 1, wherein a lubricant is arranged in at least one of said recesses (24, 24').

9. A column according to claim 1, wherein adjacent to the bottom plate (8), the area between the inner guide tube (5, 5') and the outer tube (16) is closed by a bottom ring (19) formed in one piece with the stand pipe (1, 1').

10. A column according to claim 1, wherein the bottom plate (8) is formed in one piece with the stand pipe (1, 1').

11. A column according to claim 1, wherein the partial cylindrical surfaces (25, 25') are formed by broaching.

* * * * *